United States Patent [19]

Fassman et al.

[11] Patent Number: 4,697,517

[45] Date of Patent: Oct. 6, 1987

[54] INKING APPARATUS FOR A MAILING MACHINE

[75] Inventors: Arnold Fassman, Westport; William Salancy, Norwalk, both of Conn.

[73] Assignee: Pitney Bowes Inc., Stamford, Conn.

[21] Appl. No.: 773,152

[22] Filed: Sep. 6, 1985

[51] Int. Cl.[4] ..... B41F 1/46; B41F 31/14

[52] U.S. Cl. ..... 101/348; 101/103; 101/295; 101/301; 101/310; 101/324; 101/335; 101/359

[58] Field of Search ..... 101/103, 295, 305, 348, 101/371, 420, 301, 310, 324, 335, 359

[56] References Cited

U.S. PATENT DOCUMENTS

| | | | |
|---|---|---|---|
| 3,759,178 | 9/1973 | Franchinot et al. | 101/348 X |
| 3,785,288 | 1/1974 | Hunter | 101/348 |
| 4,051,781 | 10/1977 | Nishikawa | 101/348 |
| 4,152,984 | 5/1979 | Utzinger | 101/103 X |
| 4,252,060 | 2/1981 | Strausberg | 101/295 |
| 4,273,046 | 6/1981 | Sato | 101/348 |
| 4,387,645 | 6/1983 | Holland-Letz et al. | 101/305 X |
| 4,428,146 | 10/1984 | Mistyurik | 101/348 X |
| 4,440,083 | 4/1984 | Hooper | 101/348 |

*Primary Examiner*—Edgar S. Burr
*Assistant Examiner*—James R. McDaniel
*Attorney, Agent, or Firm*—Lawrence E. Sklar; Melvin J. Scolnick; David E. Pitchenik

[57] ABSTRACT

In a mailing machine, having a removable postage meter with a rotatable printing drum and printing die there is an inking apparatus included with the mailing machine. The inking apparatus has a ink supply cartridge which engages an ink transfer roller mounted in a frame of the inking apparatus. A cam member operatively associated with the transfer roller prevent ink contamination of the postage meter when the meter is installed or withdrawn from the mailing machine.

2 Claims, 9 Drawing Figures

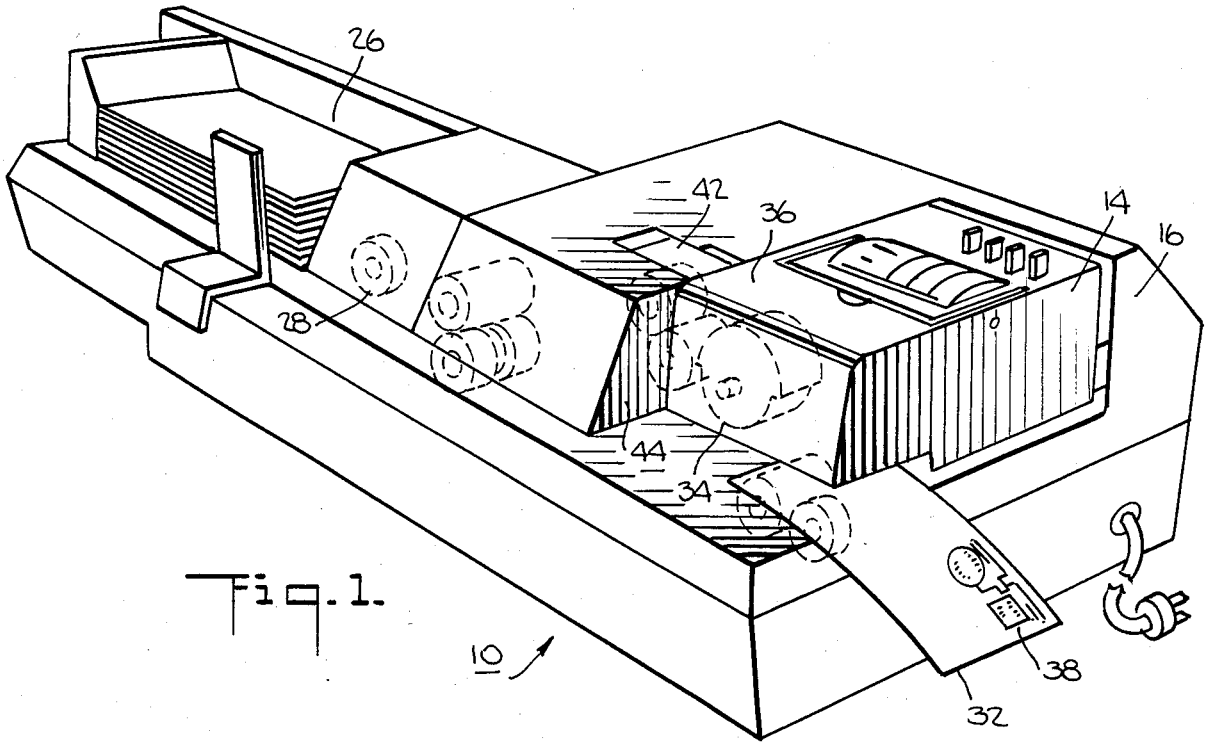
Fig. 1.
Fig. 2.
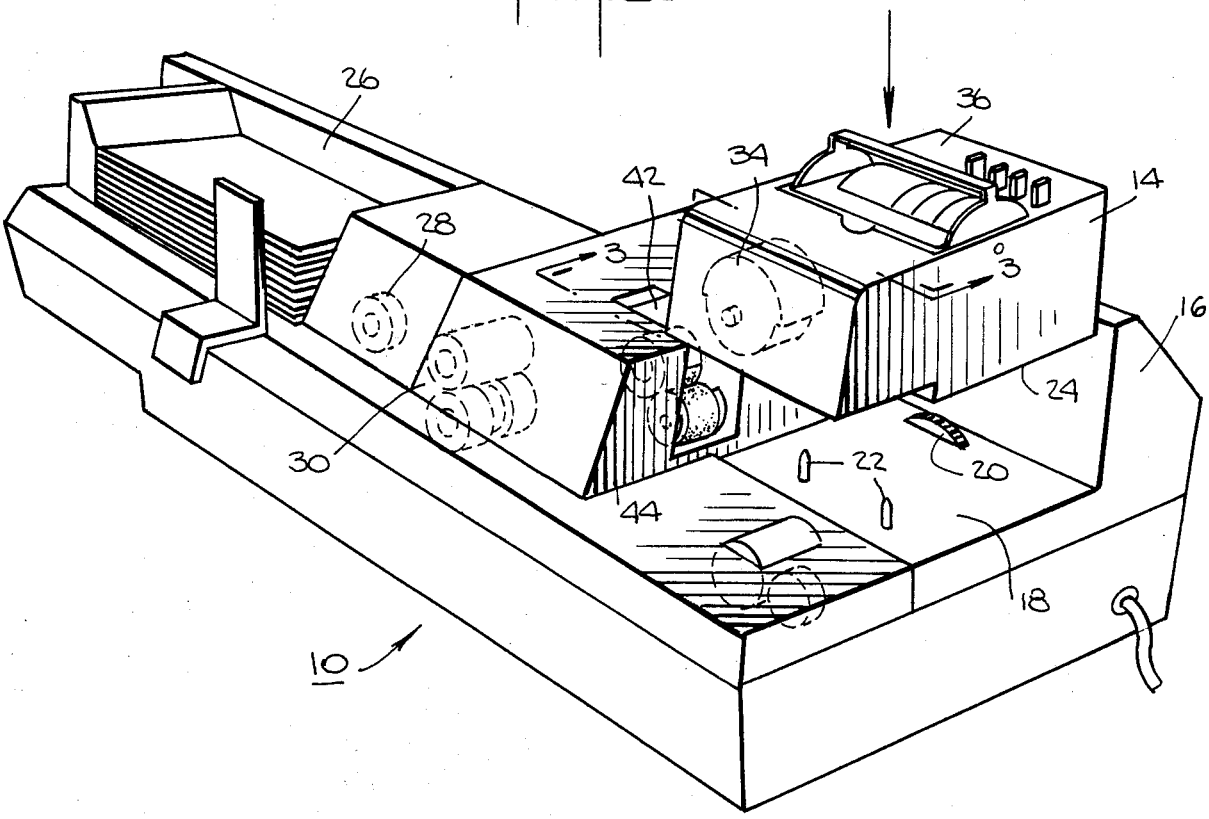

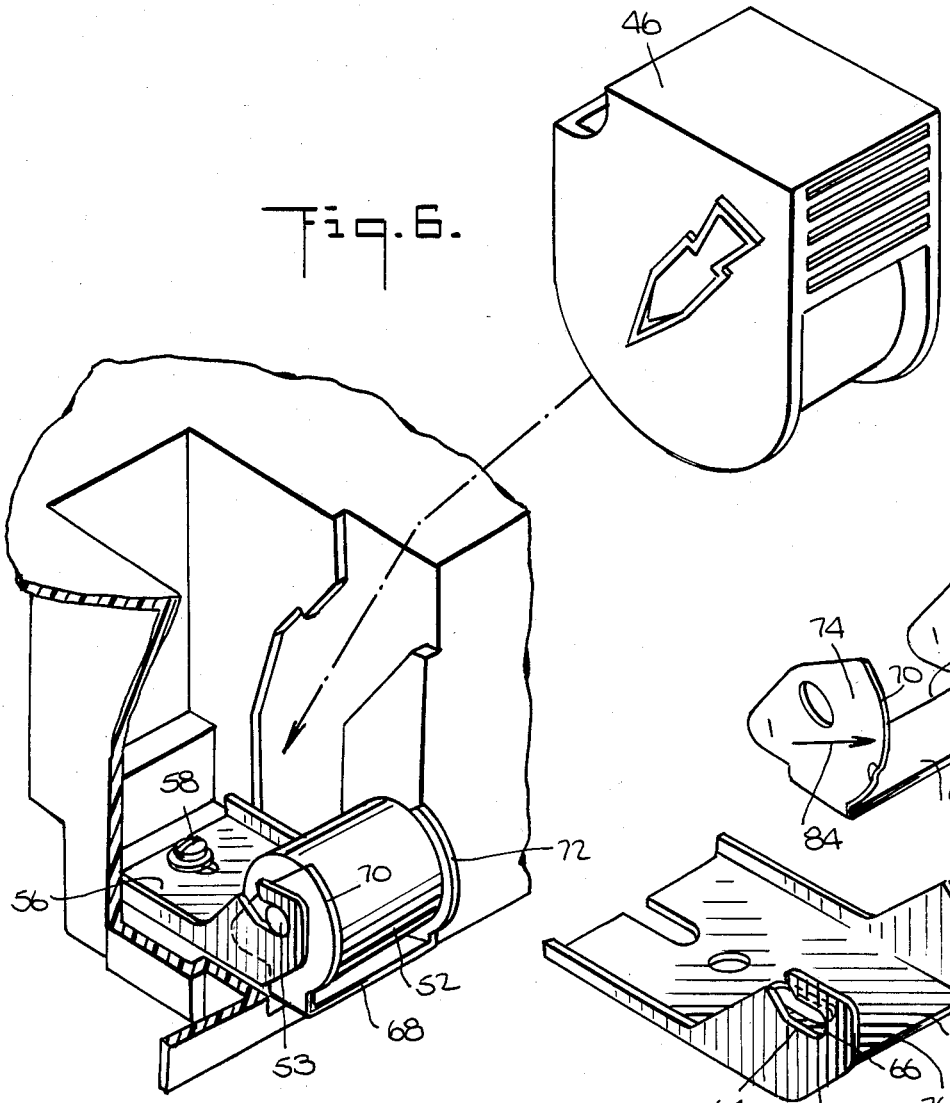
Fig. 6.
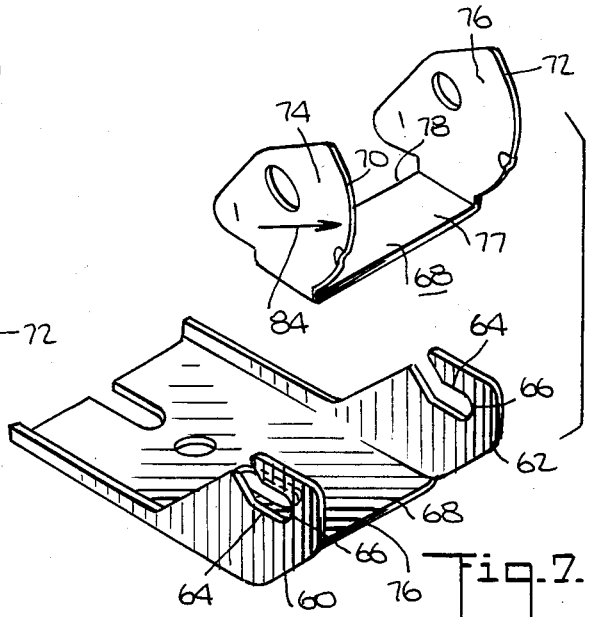
Fig. 7.
Fig. 5.
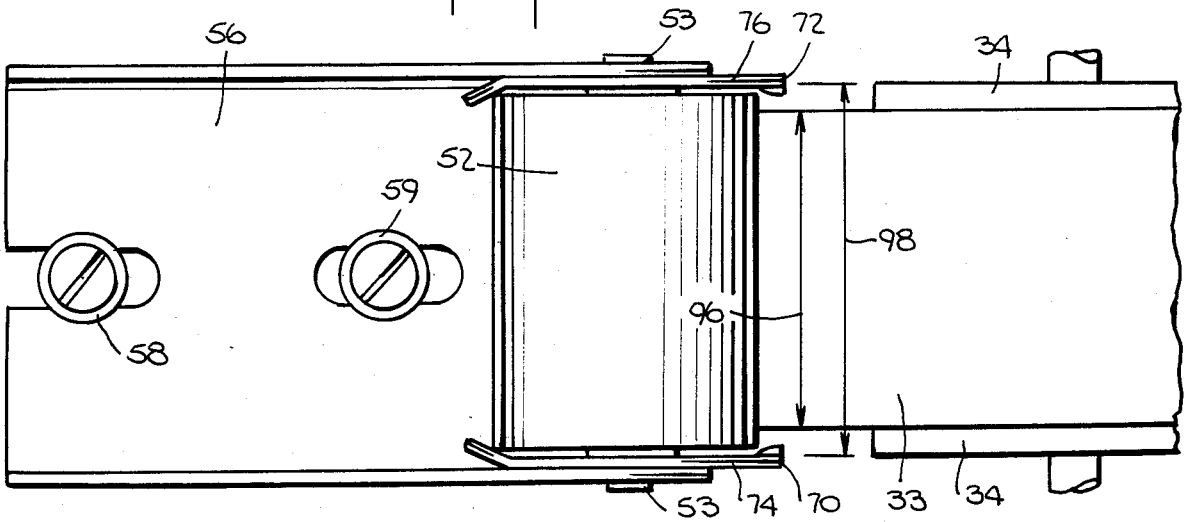

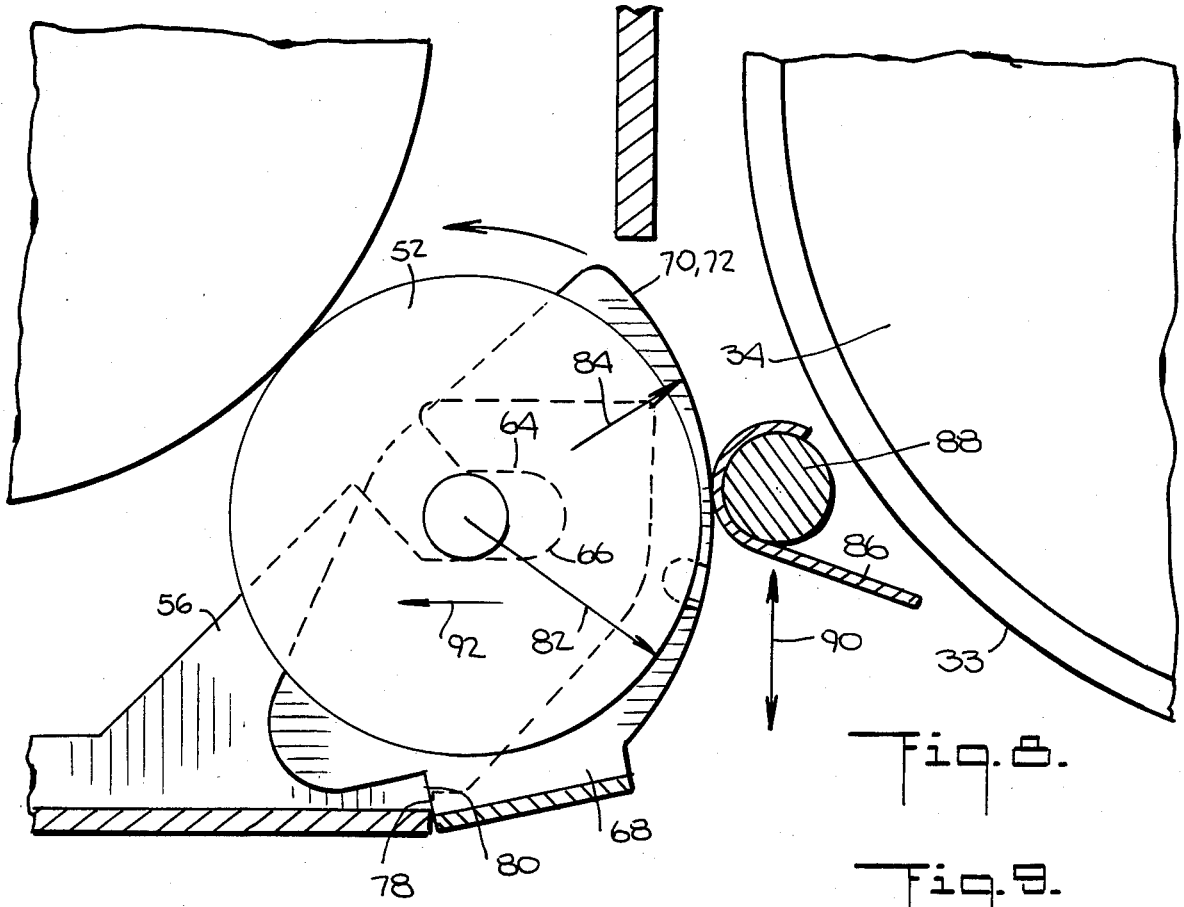
Fig. 8.
Fig. 9.
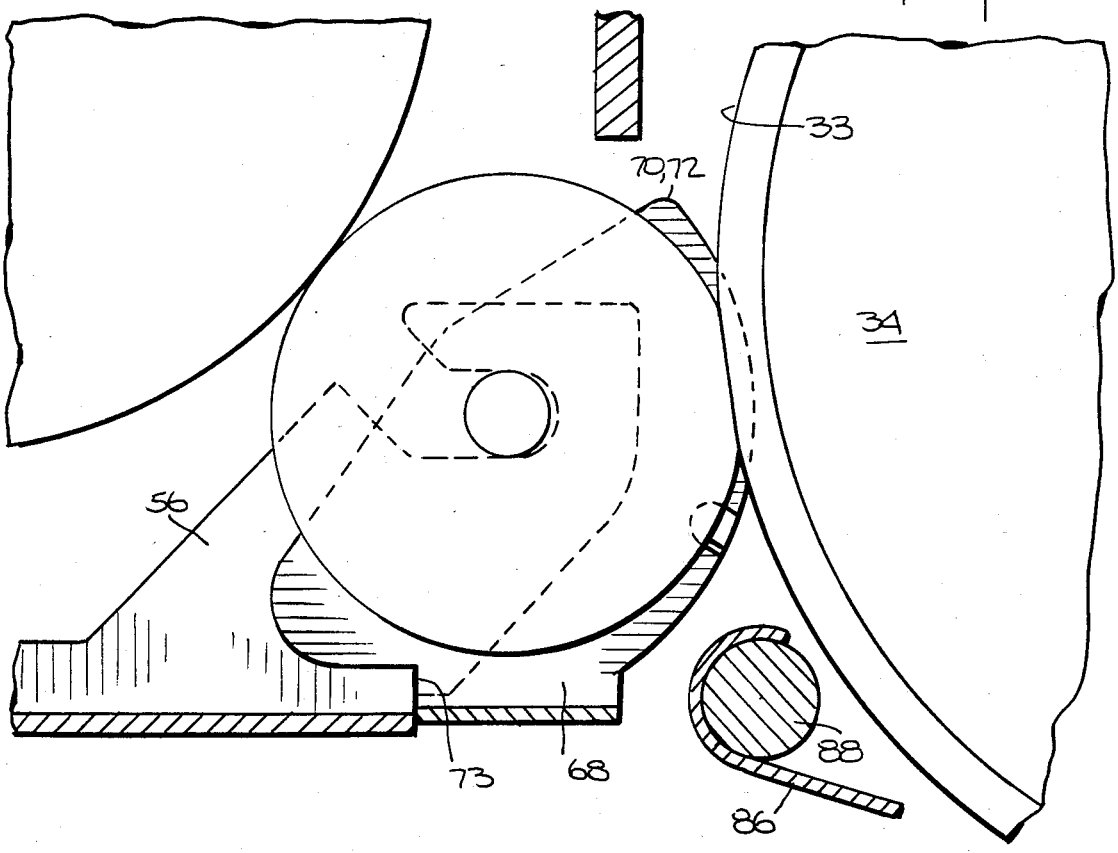

INKING APPARATUS FOR A MAILING MACHINE

FIELD OF THE INVENTION

Background of the Invention

The present invention relates to an inking apparatus for applying ink to a printing die in a printing apparatus. In particular, the present invention is directed to use in a mailing machine having a removable postage meter. The mailing machine and postage meter together provide a printed indicia of postage on envelopes or strips of tape when such articles are processed through the machine.

Postage meters which are capable of being removed from the mailing machine have been in use for a long while. The convenience of bringing the postage meter to the office for accounting purposes has been an advantage since the meters are typically relatively small in comparison to the size and weight of the mailing machine.

A problem has developed with the advent of modern mailing machines having cartridge style ink supplies. The problem concerns ink contamination with respect to the removal and replacement of the postage meter on the mailing machine. This problem has been tolerated, as is readily apparent with some available mailing machines. In the area of the mailing machine where the inking apparatus is located, the postage meter is typically designed to be in close relationship to the ink transfer roller. For example, when the meter is removed from the mailing machine, portions of the meter including a shielding member for the printing drum, and a portion of the meter cover may contact the transfer roller as the meter is lifted off of the mailing machine. In the reverse operation, the aforementioned components of the meter may rub against the transfer roller. In the first case, those areas of the meter will be contaminated with postage meter ink, and this may then be transferred to clothing or the like which of course is highly undesirable. In the case where the meter is being reinstated it is possible that the same components of the meter will inadvertently bear against the ink transfer roller. In some cases, an accumulation of ink occurs on the bottom portions of the meter shielding member or cover which then has been found to drip and consequently contaminate the mail pieces moving beneath that particular point of the machine.

THE PRIOR ART

Pitney Bowes mailing machines, such as the model 5460, 5600 and 6100 which operate in cooperation with the model 5300 or 6500 postage meters have a similar apparatus between them which causes the entire inking apparatus to move away from the postage meter when the meter locking lever is released. The meter locking lever normally retains the aforementioned postage meters in a close physical relationship to the mailing machine, and when released enables the meter to be vertically removed from the mailing machine base. There is typically a mechanical connecting device between the meter locking lever and a movable support for the inking apparatus which enables the inking apparatus, or as a minimum, the ink transfer roller to move away from the meter when the lock lever is released. U.S. Pat. No. 3,491,685, issued to H. Tramposch discloses a Rotatable Ink Storage and Metering Cartridge. The patent relates to an ink dispensing cartridge composed of a first foam material with large pores which act as an ink reservoir, and a second foam material with smaller pores positioned in contact with the first foam and exposed to a portion of the exterior of the cartridge to provide ink to an applicator roller.

U.S. Pat. No. 3,745,920, issued to McKay discloses an inking device with guard means. There is a rotary inking device described with a rotary inking wheel and guard means for selective pivotal movement. The guard is pivoted with the inking apparatus from a vertical to an alternate 90° position. The guard is intended to protect the user from coming into contact with the inking wheel.

U.S. Pat. No. 3,759,178, issued to Franchinot disclosed an inking roller assembly for a rotary printing drum such as that in a postage meter. The assembly includes a holder for positioning the inking roller for contact with the rotary printing drum. The holder is designed to apply pressure to the inking roller which ultimately causes ink to be transferred to the drum.

U.S. Pat. No. 3,785,288 issued to Hunter discloses a Ink Roll Cartridge. The patent relates to a cartridge having an ink roll encased within two cylindrical elements mounted for limited rotation with respect to each other. The patent also discloses means for moving the cartridge toward and away from the printing members.

U.S. Pat. No. 4,018,156 issued to Giordano discloses a Document Imprinter. The patent relates to a document imprinter, especially for labels and the like. There is a rotary printing unit disclosed with an inking roller, with novel means for adjusting the position of the inking roller relative to the printing unit. The adjusting means includes locating means in the form of a plurality of flat surfaces each located at a different distance from the rollers axis of rotation.

Therefore, having briefly described the prior art, a brief summary is presented to point out the advantages of the present invention.

SUMMARY OF THE PRESENT INVENTION

The present invention relates to a mailing machine having a removably mounted postage meter. The postage meter has a rotatable printing drum which carries a postage impression printing die. A guard member extends laterally across the printing die to prevent unauthorized access into the meter printing die area. There is an ink supply cartridge having a supply roller and a transfer roller for transferring ink from the ink supply cartridge to the printing die. An apparatus is provided for mounting the ink supply roller and the transfer roller, for allowing the transfer roller to rotate about the axis of the supply roller and for lateral displacement of the transfer roller towards and away from the printing drum. A cam device is mounted on the apparatus in position to be engaged by the guard member during installation and removal of the postage meter on and from the mailing machine. The guard member causes the transfer roller and the ink supply roller to be moved away from the printing drum during the installation and removal process, thereby preventing the transfer roller from depositing ink on the guard member. The invention further includes the cam device which is generally a U-shaped member having a pair of oppositely facing ears connected by a bridge. The ears have curved cam surfaces formed along the sides thereof.

Therefore, having briefly described the present invention for applying ink to the printing die of a postage meter, some objects of the present invention are now discussed.

It is an object of the present invention to provide an apparatus for eliminating the transfer of ink from an ink transfer roller located in an inking apparatus of a mailing machine, to the exposed portions of a postage meter adjacent to the printing die during the removal or replacement of the postage meter to or respectively from the mailing machine.

It is a further object of the present invention to provide for a printing machine an inking apparatus having a guard member which will assist in preventing accidental contamination of adjacent machine components.

It is a still further object of the present invention to provide an inking apparatus for a mailing machine, which when exposed by a removed postage meter will present less opportunity of accidental contamination of objects, including articles of clothing of a machine operator.

It is another object of the present invention to prevent excess ink from contaminating envelopes being fed through the machine.

BRIEF DESCRIPTION OF THE DRAWINGS

FIG. 1 is an isometric front view of a mailing machine having a removable postage meter adapted thereto.

FIG. 2 is an isometric view taken along the same lines of FIG. 1, showing the postage meter partly removed from the mailing machine.

FIG. 5 is an enlarged, partial top view of the inking apparatus of the present invention as taken from FIG. 4.

FIG. 6 is an enlarged isometric view of the inking apparatus as taken from FIG. 2. The inking cartridge is shown removed from the mailing machine.

FIG. 7 is a partial isometric view taken along the same lines as FIG. 6, showing the details of the inking apparatus.

FIG. 8 is a greater enlarged view taken along the same lines as FIG. 3, showing the interaction of the inking apparatus of the present invention with the postage meter.

FIG. 9 is a view taken along the same lines as FIG. 8, showing the inking apparatus in position with the printing drum.

DESCRIPTION OF THE PREFERRED EMBODIMENT

Figure 3:
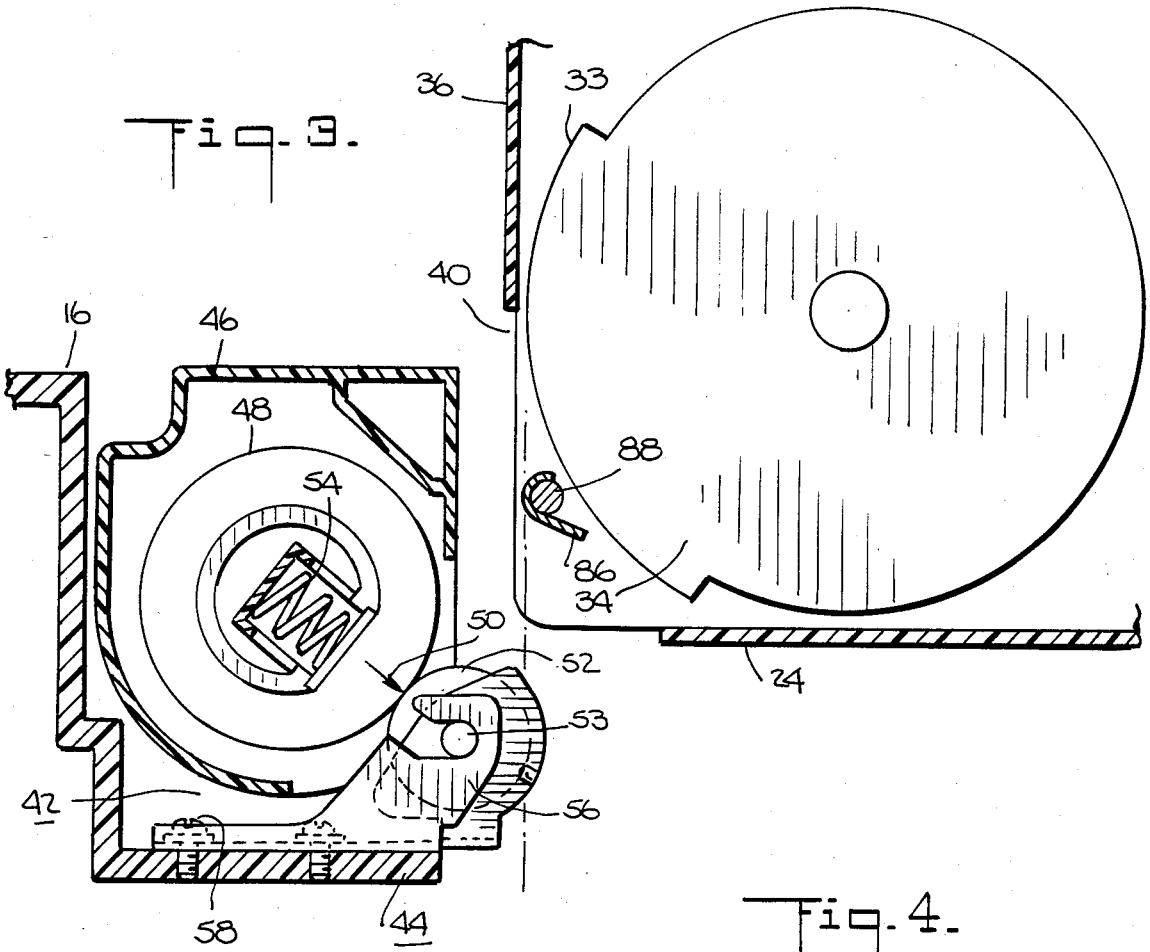
FIG. 3 is an enlarged, partial, sectional view taken along the lines of 3—3 from FIG. 2, showing the relationship of the inking apparatus of the present invention to the printing drum of the postage meter when the postage meter is installed on the mailing machine.

Referring to FIG. 1 and FIG. 2, there is shown a mailing machine 10, having a removable postage meter 14 mounted thereon. The mailing machine 10 has an upper cover 16 having a meter locating deck 18 with a number of upstanding meter locating members 22 (FIG. 2) which serve to accurately locate the meter 14 in an operating position with the mailing machine 10. There is a main power drive system provided with the mailing machine 10 for causing the various components of the machine 10 to rotate, and subsequently convey mail. The main power system and associated drive components are not shown or described but will be understood to exist for the purposes to be set forth with the description of the present invention. There is additionally a main electric motor (not shown), understood to be included with the mailing machine 10, for providing a power source for all required cyclic operations of the machine 10, and the attached postage meter 14. Typically a 115 VAC line source provides the required electricity to power the electric drive motor, as well as other electrically driven devices in both the machine 10 and meter 14.

Referring to FIG. 2, the meter 14 is shown partially removed from the meter locating deck 18. The meter locating members 22 are arranged to receive and adapt to locating apertures within a bottom surface 24 of the meter 14, while the meter 14 is lowered downwardly towards the deck 18. When the bottom surface 24 of the meter 14 is resting on the deck 18, the meter 10 is said to be located in its predetermined operating position. In this position a gear 20, driven by the cyclic power drive system is engaged with a corresponding gear (unshown) located within the meter 10 for rotatably driving the meter 14. The mailing machine 10 is then ready to process mail which for the purposes of the present invention is in the form of envelopes. The envelopes are stacked in a supply hopper 26, and an appropriately driven separator wheel 28 causes one envelope at a time to be fed, and advanced seriatim along an envelope transport path 30. Alternately, envelopes may be individually fed through the machine. An envelope 32 is shown in FIG. 1, having been imprinted by a printing drum 34, located within a protective cover 36 of the meter 14. The envelope 32 has a printed indicia 38 which is representative of a metered stamp.

As was briefly mentioned in the prior art segment of the present invention, there is an annoying problem associated with the removal and replacement of a postage meter on a mailing machine having a cartridge style inking apparatus. The problem relates to contamination of the mail by excess ink which comes from the inking apparatus of the machine 10. The excessive ink has a distasteful way of soiling protective components associated with the printing drum area of the postage meter 14, the adjacent cover members of the meter 10, or clothing of an operator who handles the postage meter when he or she accidentally touches the areas located adjacent to an opening 40 (FIG. 3) located on or adjacent to the printing drum 34 of the postage meter 14.

Figure 4:
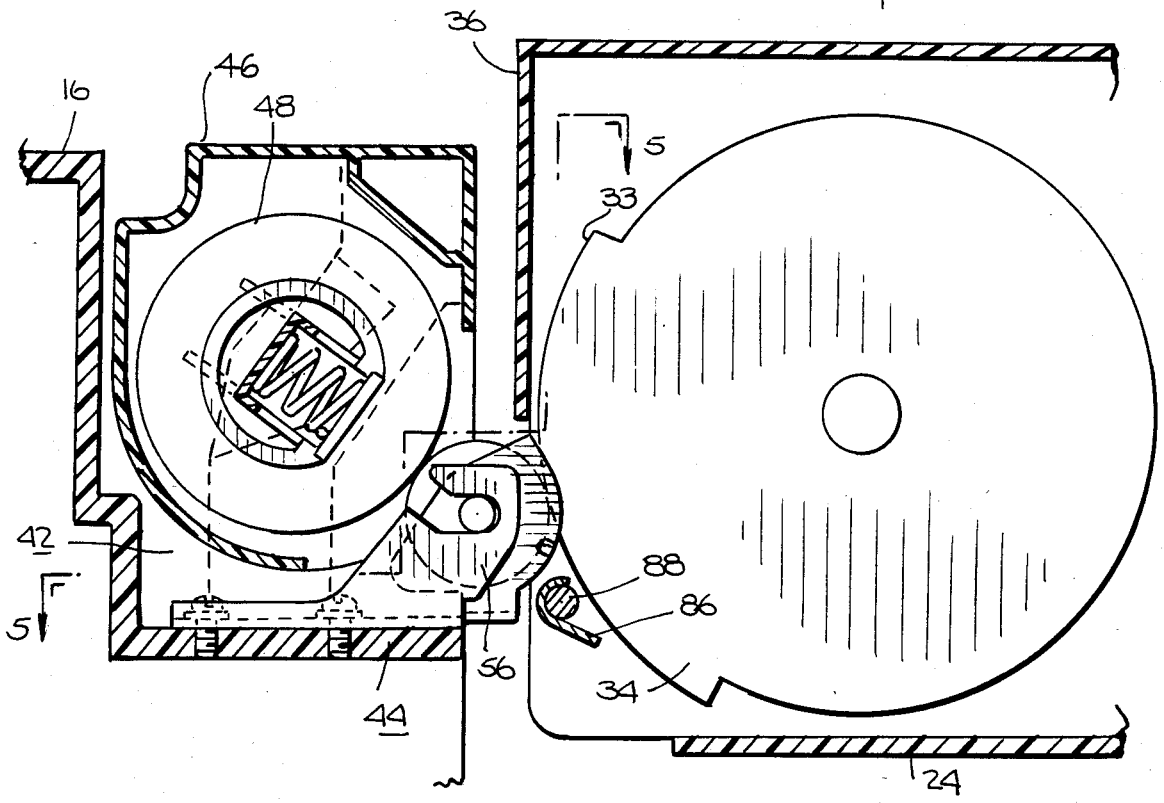
FIG. 4 is an enlarged, partial sectional view taken along the same lines as FIG. 3, showing the relationship of the postage meter printing drum to the inking apparatus of the present invention.

Referring to FIG. 3, there is shown an inking apparatus 42 located within an upper section 44 of the mailing machine cover. The inking apparatus 42 is shown somewhat enlarged in FIG. 3 and FIG. 4 so that specific components of the inking apparatus 42 may be more easily identified. There is an ink supply cartridge 46 which is pre-loaded with a supply of ink for a predetermined number of rotary impressions by the printing drum 34. The ink supply cartridge 46 is the subject of an issued U.S. Pat. No. 4,440,083, which may be referred to gain more understanding of the assembly and utility of the cartridge 46. It will be seen in FIG. 3 and FIG. 4 that a supply roller 48 is resiliently biased in a direction 50 against an ink transfer roller 52. There is a compression spring 54 which supplies the required biasing force, and thereby maintains the ink transfer roller 52 in position to engage and transfer a supply of ink to a printing surface 33 of the printing drum 34. There is a support bracket 56 which is appropriately fastened by a screw 58 and a screw 59 to the section 44 of the cover 16 of the mailing machine 10. The support bracket 56 has two upstanding flanges 60 and 62 (FIG. 7) each having a laterally disposed slot 64 for rotatably supporting the ink transfer roller 52, which has an end journal 53 on each axial end. The end journals 53 of the ink transfer roller 52 are limited for movement towards the printing drum 34 by a radius 66 of the slot 64 in each respective flanged ear 60 and 62 of the support bracket 56. The roller 52 remains under the biasing influence of the aforementioned spring 54, located within the cartridge 46, and therefore is urged towards the printing drum 34. There is a generally U-shaped cam member 68 mounted co-axially on the end journals 53 of the roller 52. The cam member 68 has cam surfaces 70 and 72 formed on oppositely facing ears 74 and 76 respectively which are connected together by a bridge 77. The cam member 68 is relatively free to pivot about its mounting center on the journals 53 previously described and is limited for substantial rotation by a surface 78 (FIG. 8) when engaged by a surface 80 of the support bracket 56.

It will be further seen in FIGS. 8 and 9 that a radius 82 of the roller 52 is slightly less than a radius 84 constituting the cam surface 70 and 72 such that the cam member 68 is acted upon by protruding external members associated with the postage meter 14 which otherwise would strike the roller 52 when the meter 14 is withdrawn from the mailing machine 10.

For example, there is a shielding member 86 which is permanently mounted on a rod 88, the rod 88 in turn fixed to the structural frame (not shown) of the postage meter 14. The shielding member 86 is positioned to protect exposed portions of the meter printing drum 34 at all times, but is positioned such that it would normally intersect the roller 52 whenever the meter is lifted in a vertical direction 90 from the meter locating deck 18. In the course of lifting or lowering the meter 14 from the deck 18, the shielding member 86 strikes the (FIG. 8) cam member 68 on the cam surfaces 70 and 72, and the roller 52 is therefore held away from the shielding member 86. In FIG. 8, it is seen that the shielding member 86 is pushing against the cam surfaces 70 and 72 so that the cam member 68 has moved in a direction 92, along the slots 64 of the support bracket 56.

Referring to FIG. 9, it is seen that the roller 52 is positioned in the operating position where ink is transferred to the printing drum 34. When the roller 52 is in the ink transfer position, the ears 74 and 76 straddle the printing drum surface, where the printing surface 33 is located (FIG. 9), at a width 96 (FIG. 5), and the ears 74 are spaced apart at a width 98, (FIG. 5) which allows the corresponding parts to fit together.

Therefore, having described the present invention in detail, it will be clear that a means has been provided to avoid contamination caused by ink transferral from a ink supply roller to the exposed projecting parts of a postage meter when the postage meter is removed from a mailing machine.

Furthermore, although a preferred embodiment of the invention has been disclosed in detail for illustrative purposes, it will be recognized that the invention has utility with respect to other printing devices and that variations or modifications of the disclosed apparatus, including the rearrangement of parts lie within the scope and claims of the present invention.

What is claimed is:

1. In a mailing machine having a postage meter removably mounted therein, the postage meter having a rotatable printing drum which carries a postage impression printing die thereon and a guard member extending laterally across the printing die for protecting said printing drum and to prevent unauthorized access thereto, the mailing machine also including an ink supply cartridge having a supply roller, and a transfer roller for transferring ink from the ink supply cartridge to the printing die, and means mounting said supply roller and said transfer roller both for rotation about the axis of said supply roller and said transfer roller and for lateral displacement toward and away from said printing drum, the improvement comprising:

a generally U-shaped member mounted on said mounting means and having a pair of oppositely facing ears connected by a bridge, said ears having curved cam surfaces formed along the sides thereof remote from said supply roller for sliding contact by said guard member during installation and removal of said meter, wherein said guard member causes said transfer roller and said ink supply roller to be translated away from said printing drum during said installation and removal, thereby preventing said transfer roller from depositing ink on said guard member.

2. The improvement according to claim 1 wherein said U-shaped member is mounted on end journals protruding from opposite side of said transfer roller whereby said U-shaped member displaces said transfer roller and said supply roller laterally during installation and removal of said meter.

* * * * *